US010710856B2

(12) United States Patent
Chaput et al.

(10) Patent No.: US 10,710,856 B2
(45) Date of Patent: Jul. 14, 2020

(54) UTILITY TOWER LEVELING APPARATUS AND METHOD

(71) Applicant: AMPJACK INDUSTRIES LTD., Winnipeg (CA)

(72) Inventors: Luke J. Chaput, Selkirk (CA); Nathan Stahl, Winnipeg (CA)

(73) Assignee: AMPJACK INDUSTRIES LTD., Winnipeg (CA)

( * ) Notice: Subject to any disclaimer, the term of this patent is extended or adjusted under 35 U.S.C. 154(b) by 0 days.

(21) Appl. No.: 16/200,033

(22) Filed: Nov. 26, 2018

(65) Prior Publication Data

US 2019/0161332 A1 May 30, 2019

Related U.S. Application Data

(60) Provisional application No. 62/590,605, filed on Nov. 26, 2017.

(51) Int. Cl.
*B66F 3/24* (2006.01)
*B66F 11/04* (2006.01)
(Continued)

(52) U.S. Cl.
CPC ..... *B66F 11/04* (2013.01); *E04H 12/344* (2013.01); *E04H 12/10* (2013.01)

(58) Field of Classification Search
CPC ..... B66F 3/46; B66F 7/20; B66F 3/24; B66F 7/10; B66F 7/16; B66F 11/04; E04H 12/344; E04H 12/10; E04H 12/34
See application file for complete search history.

(56) References Cited

U.S. PATENT DOCUMENTS 2,040,010 A * 5/1936 McMahon ..... E04H 12/2292 52/127.2
2,530,807 A * 11/1950 Campbell ..... E04H 12/18 254/92
(Continued)

FOREIGN PATENT DOCUMENTS

CN 203594058 U 5/2014
CN 203668981 U 6/2014
(Continued)

OTHER PUBLICATIONS

Search Report and Written Opinion issued in Int'l App. No. PCT/CA2018/051498 (2019).

*Primary Examiner* — Brian E Glessner
*Assistant Examiner* — Daniel J Kenny
(74) *Attorney, Agent, or Firm* — Barnes & Thornburg LLP; Mark J. Nahnsen

(57) ABSTRACT

A lattice type transmission tower leveling device for leveling a transmission tower with respect to a ground surface. The tower leveling device includes a series of side supports positioned at first and second sides of the transmission tower. The leveling device also includes a support beam that is secured to a third side of a transmission tower that is leaning and a second support beam that is secured to a fourth side of the transmission tower opposite the third side. The device further includes a series of brace members that are interconnected to form a lattice brace structure. The lattice brace structure is coupled to the upright members of the transmission tower. The tower leveling device also includes a lift beam secured to the side supports of the tower and a series of hydraulic cylinders that extend from the lift beam to the first support beam. Linear movement of the cylinders causes the transmission tower to rotate about the axis of
(Continued)

rotation so that the tower can be leveled and new tower base supports can be installed.

18 Claims, 13 Drawing Sheets

(51) Int. Cl.
*E04H 12/34* (2006.01)
*E04H 12/10* (2006.01)

(56) References Cited

U.S. PATENT DOCUMENTS 4,028,792 A * 6/1977 Tax ..... B66C 23/283 29/431
4,598,509 A * 7/1986 Woolslayer ..... E02B 17/00 52/115
4,644,709 A * 2/1987 Baumann ..... E04B 1/34823 52/127.2
4,678,372 A * 7/1987 Cousty ..... E02B 17/00 405/196
4,841,897 A * 6/1989 Claflin ..... B60P 3/32 114/123
6,115,988 A * 9/2000 Reisdorff ..... E04H 12/34 52/123.1
7,062,883 B1 6/2006 Langholz et al.
9,097,033 B2 * 8/2015 Margevicius ..... E04H 12/344
9,562,367 B2 * 2/2017 Chaput ..... B66F 3/46
9,796,568 B1 * 10/2017 Gonzales ..... B66F 5/04
2015/0361683 A1 * 12/2015 Scott, IV ..... E04H 9/14 52/79.1
2017/0022765 A1 * 1/2017 Csergei ..... B66F 3/24

FOREIGN PATENT DOCUMENTS

CN 105696617 6/2016
CN 105927027 9/2016
CN 106759556 5/2017

* cited by examiner

UTILITY TOWER LEVELING APPARATUS AND METHOD

CROSS-REFERENCE TO RELATED APPLICATION

The present invention claims priority to U.S. Provisional Application No. 62/590,605, filed Nov. 26, 2017, the entirety of which is incorporated by reference herein.

FIELD OF THE DISCLOSURE

The present disclosure relates generally to leveling equipment, and more specifically to leveling equipment used in the electric utility industry.

BACKGROUND

The electric utility industry is seeking to correct existing ground or aerial transmission line towers that have been affected by adverse conditions such as ground settling, soil erosion or frost heave and other environmental causes. Over time, existing towers that are in service and carrying a current load begin to lean to one side. Often times the towers need to be taken out of service and the towers removed and reconstructed at considerable time and expense. This also means that consumers that depend on the utilities must do without until the towers can be replaced and put back online.

SUMMARY

The present disclosure may comprise one or more of the following features and combinations thereof.

In illustrative embodiments, the present disclosure is directed to an electrical transmission tower leveling device for leveling an electrical transmission tower with respect to a ground elevation. The electrical transmission tower leveling device is designed to level "live" electrical utility towers that have tilted over time due to frost heave, ground settling and the like without the need to de-energize the towers or take them out of service.

In illustrative embodiments, the tower leveling device includes a series of side supports positioned at first and second sides of the transmission tower. The leveling device also includes a support beam that is secured to a third side of a transmission tower that is leaning and a second support beam that is secured to a fourth side of the transmission tower opposite the third side. The device further includes a series of brace members that are interconnected to form a lattice brace structure. The lattice brace structure is coupled to the upright members of the transmission tower.

In illustrative embodiments, the tower leveling device also includes a lift beam secured to the side supports of the tower and a series of hydraulic cylinders that extend from the lift beam to the first support beam. The leveling device further includes a controller for controlling the extension and retraction of the hydraulic rams. The second support beam is adapted to be pivotally coupled to the side supports to form an axis of rotation. Linear movement of the cylinders causes the transmission tower to rotate about the axis of rotation so that the tower can be leveled and new supports can be installed.

These and other features of the present disclosure will become more apparent from the following description of the illustrative embodiments.

DETAILED DESCRIPTION OF THE DRAWINGS

Figure 1:
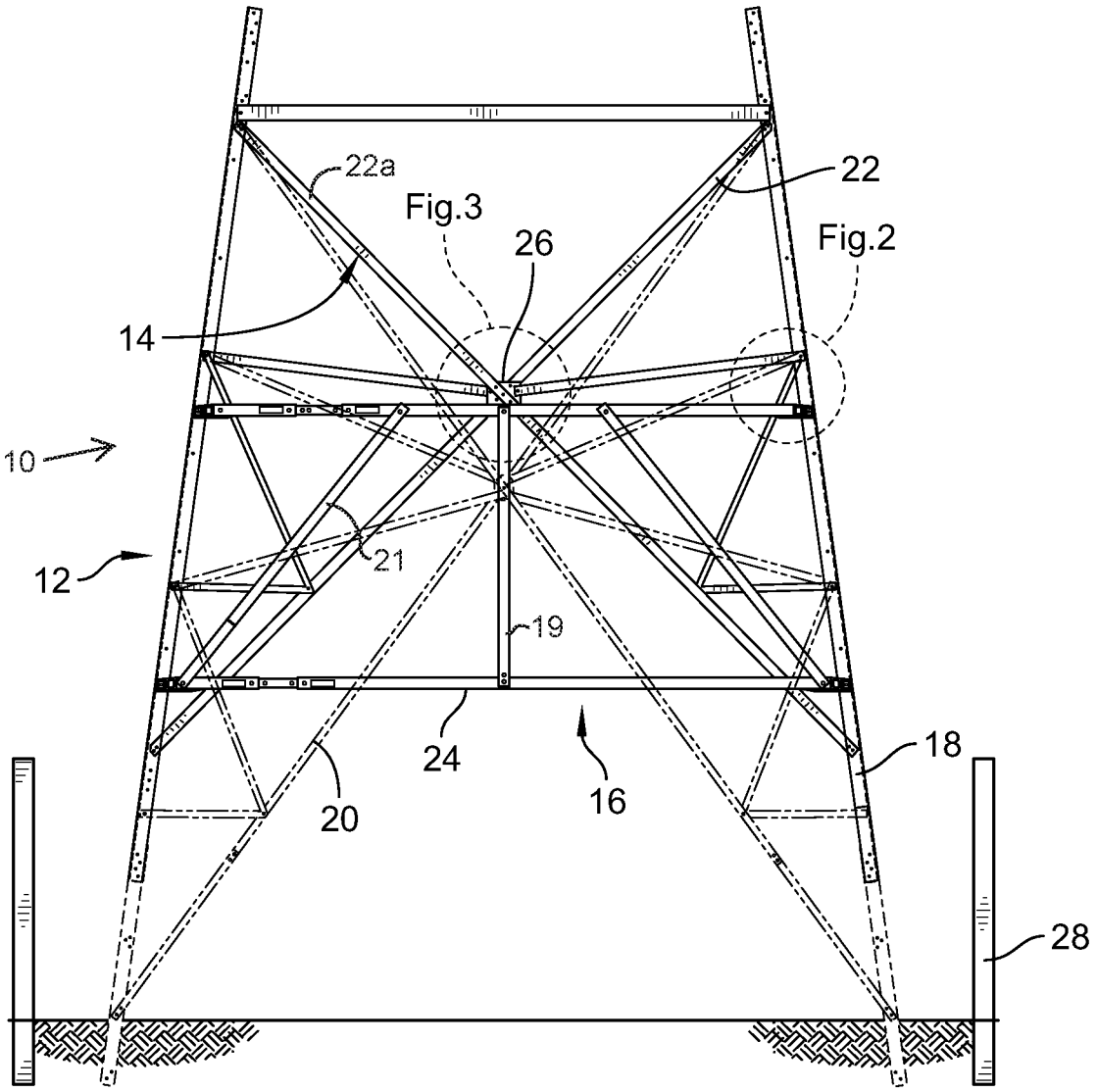
FIG. 1 is an elevational view of an embodiment of a tower leveling apparatus showing temporary bracing added to a utility tower.

For the purposes of promoting an understanding of the principles of the disclosure, reference will now be made to a number of illustrative embodiments illustrated in the drawings and specific language will be used to describe the same.

A tower leveling device 10 is shown in FIG. 1. Tower leveling device 10 is configured for use in connection with electrical transmission towers 12 used in the electrical power industry to raise a portion of the transmission towers 12 from a first height to a second height to level the tower, as shown, for example, in FIG. 19.

Tower leveling device 10 for leveling a transmission tower 12 includes a first brace support structure 14 and a second brace support structure 16, as shown in FIG. 1. The brace structures 14 and 16 maintain the structural integrity of the transmission tower 12 when leveling. FIG. 1 illustrates a portion of an electrical utility tower 12 that includes a pair of upright frame members 18 and interconnecting diagonal and horizontal support members 20. First brace support structure 14 is comprised of a series of diagonal braces 22 that are connected to the upright frame members 18 of the tower 12. Diagonal braces 22 intersect at a hub 26. Hub 26 is a rectangular plate structure that is located at approximate the midpoint of the braces 22. First brace support structure 14 can include elongated brace members 22*a* that that do not terminate at the hub 26 but extend from one upright frame member 18 on one side of the tower 12 to another upright frame member 18 on the other side of the tower 12.

Second brace support structure 16 is formed of generally horizontal members 24 that are connected to the upright frame members 18 located on opposite sides of the tower 12. Second brace support structure 16 also includes a vertical member 19 that is perpendicular to and interconnected to horizontal member 24. Second brace support structure 16 also includes diagonal members 21 that are interconnected with horizontal members 16. First and second brace support structures 14, 16 assist in maintaining the integrity of the tower 12 while the tower 12 is being leveled. First and second brace support structures 14, 16 can be secured to the four sides of the tower to maintain tower integrity. Vertically oriented support posts 28, which form part of the tower leveling device 10, are shown secured to the ground outboard of the upright frame members 18 of the tower 12.

Figure 2:
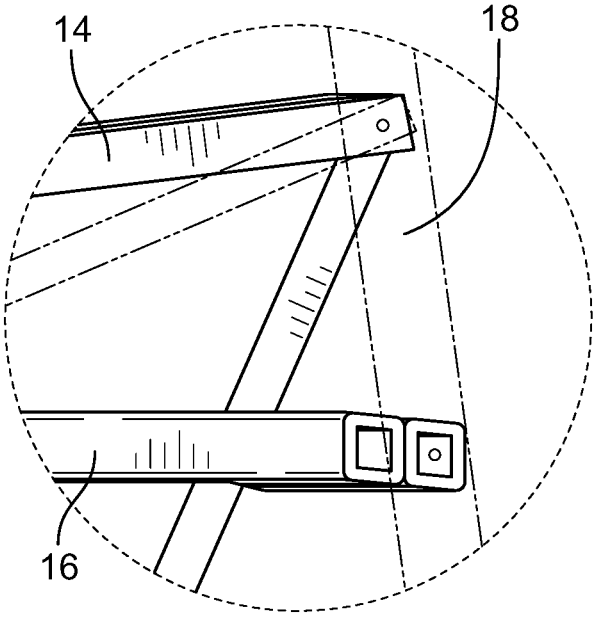
FIG. 2 is an enlarged view of FIG. 1 showing the connection of the temporary bracing to the utility tower.
Figure 3:
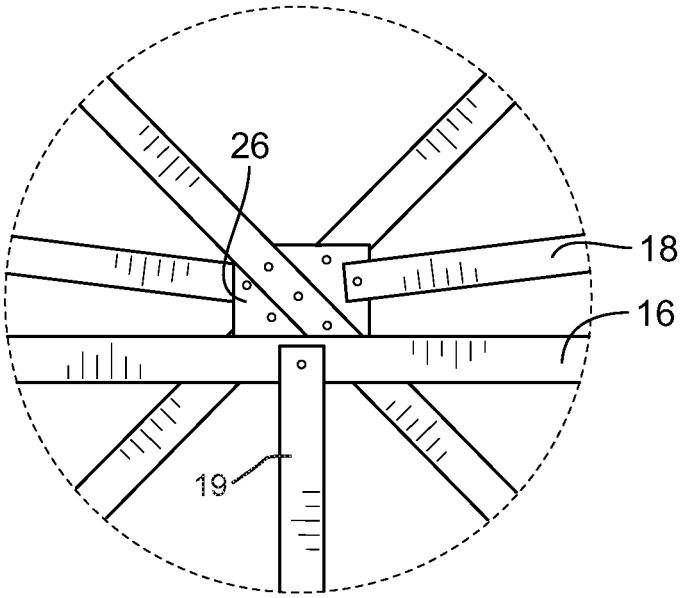
FIG. 3 is an enlarged view of FIG. 1 show the interconnection of the temporary bracing.

FIG. 2 is an enlarged view of FIG. 1 showing the connection of the first and second brace support structures 14, 16 with the upright frame members 18 of the tower 12. FIG. 3 shows the interconnection of the diagonal braces 22 with each other at hub plate 26.

Figure 4:
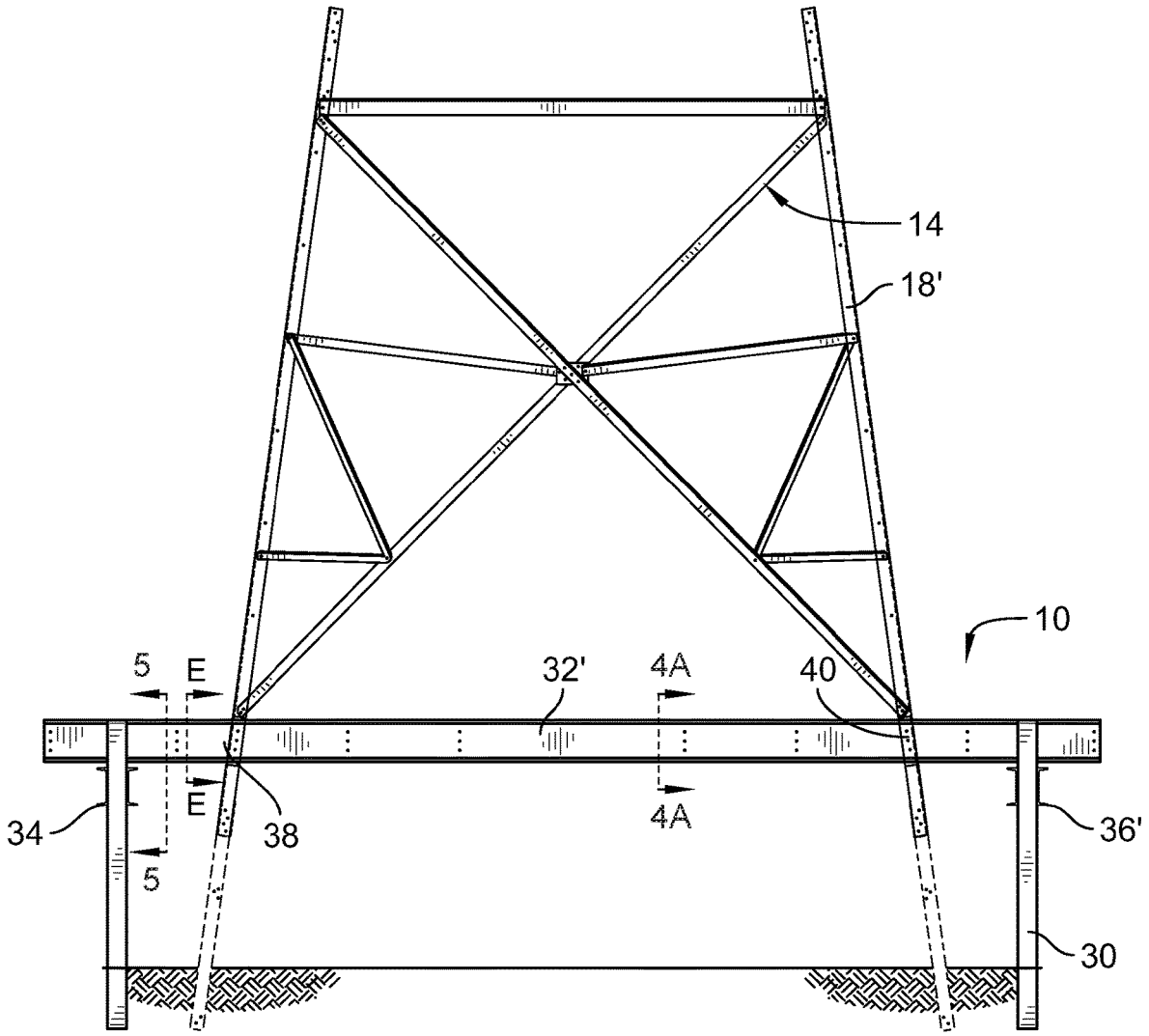
FIG. 4 is an elevation view of the longitudinal face of the tower on the low side of the tower that pivots about an axis of rotation to level the tower.
Figure 4A:
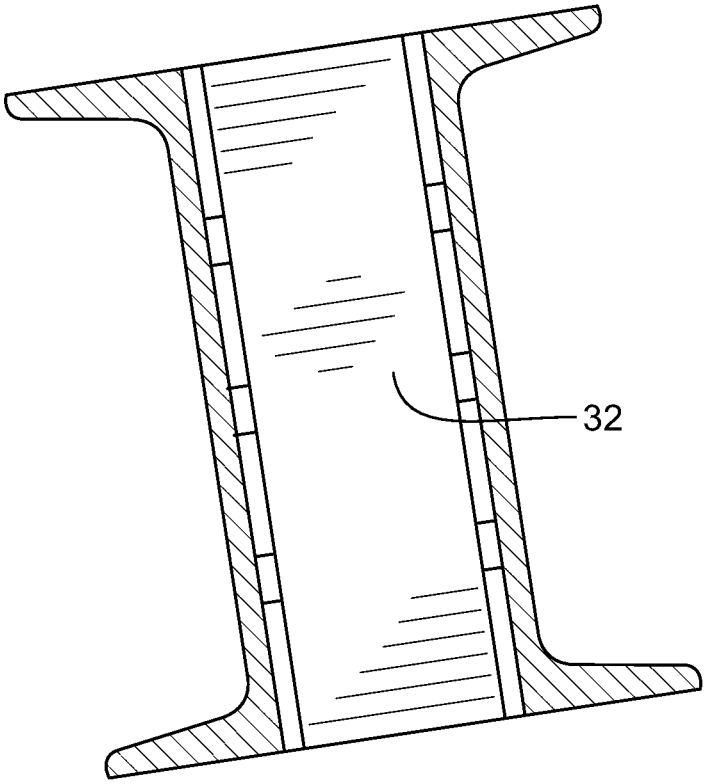
FIG. 4A is a sectional view taken along lines 4A-4A of FIG. 4.
Figure 19:
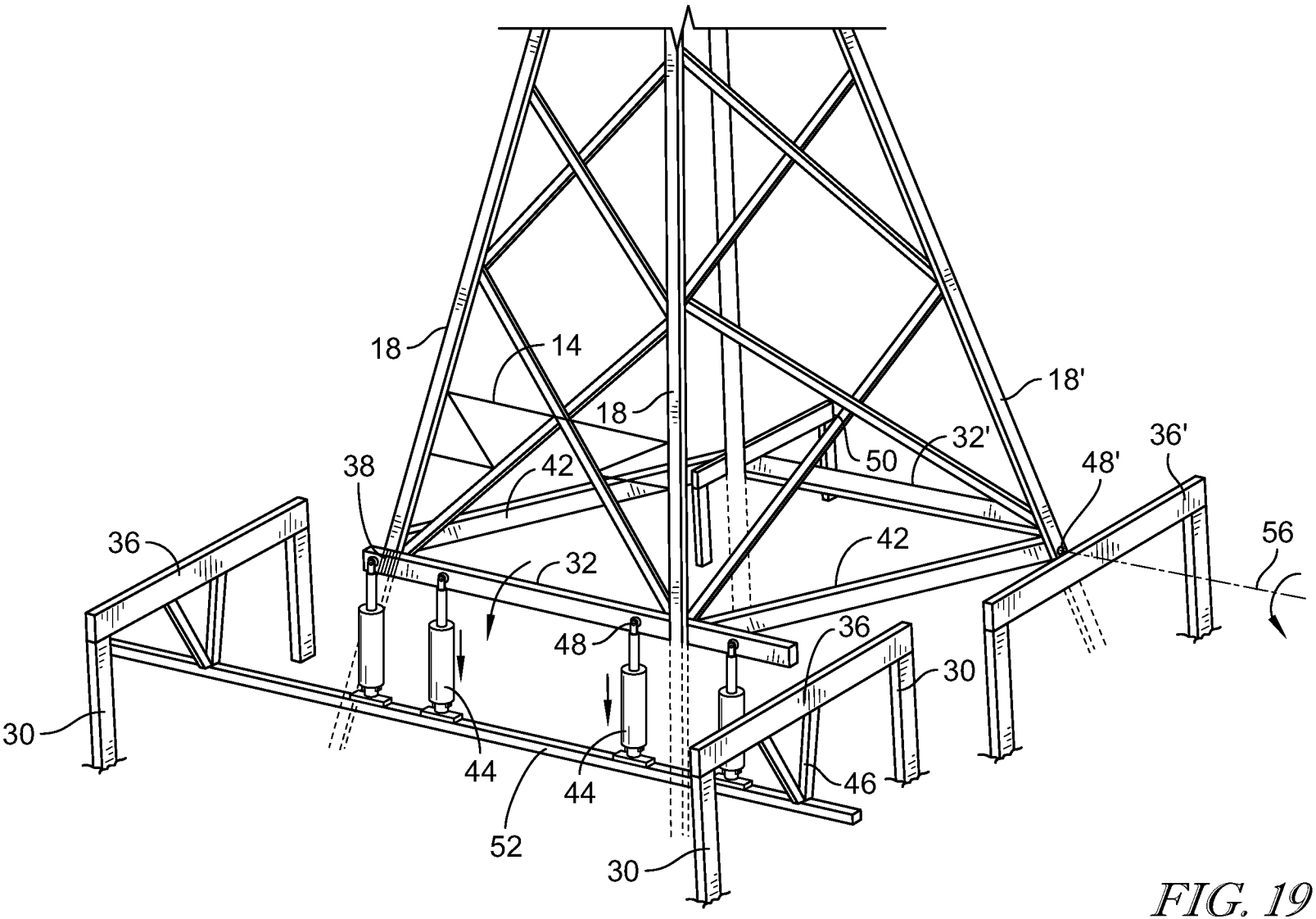
FIG. 19 is a perspective view of the tower leveling device used to level an electrical transmission tower.

FIG. 4 is an elevational view of the longitudinal face of the low side of the leaning tower 12 showing additional steel posts 30 and horizontal support beam 32 that is connected to upright frame members 18 of tower 12 at connection points 38, 40. Horizontal support beam 32 is secure to the tower 12 at these locations. This is the side of the tower 12 that pivots about a horizontal axis 56, as shown in FIG. 19. Horizontal support beam 32 is pitched at an angle as shown in FIG. 4*a*. Horizontal support beam 32 is coupled to side support beams segments 34, 36 of the tower 12.

Figure 5:
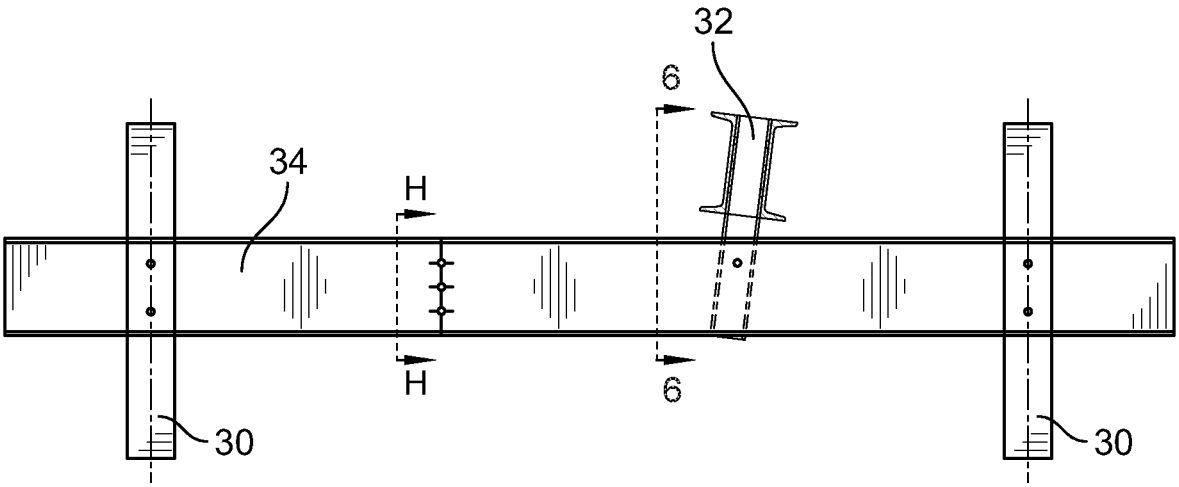
FIG. 5 is a sectional view taken about line 5-5 of FIG. 4 showing the beam segment and support posts that are used to pivotally support the horizontal beam of FIG. 4.
Figure 6:
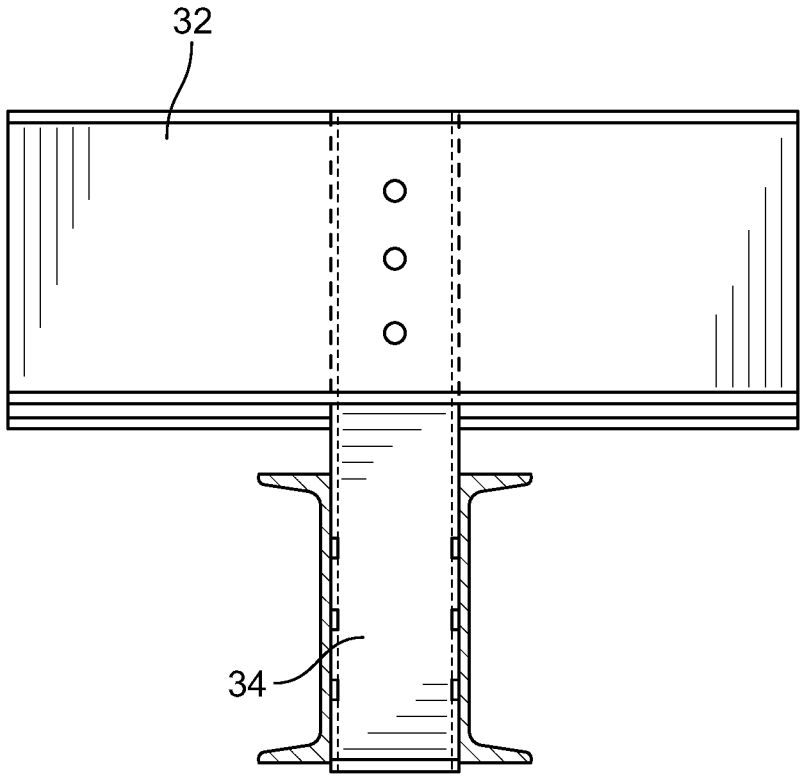
FIG. 6 is a sectional view taken along line 6-6 of FIG. 5 showing the connection of the horizontal beam to the beam segment by use of a clevis pin to permit rotation of the horizontal beam with respect to the beam segment.

Side support beam segments 34, 36 are secured to steel posts 30 with the use of clevis or cotter pin to create an axis of rotation, as shown in FIG. 5. FIG. 6 shows the horizontal support beam 32 with respect to the support beam segment 34 and the interconnection of the two is accomplished with the clevis or cotter pin. FIG. 4 also shows a second first support brace structure 14 secured to the upright frame members 18 of the tower 12 to maintain the integrity of the tower 12 during leveling.

Figure 7:
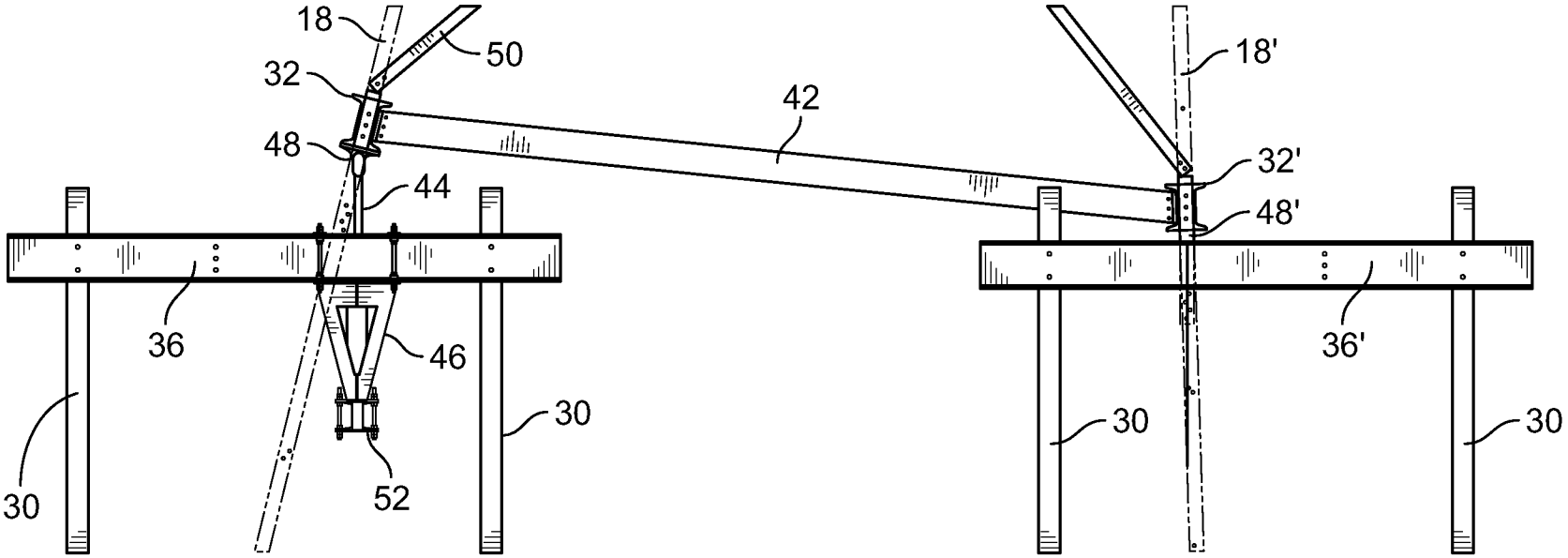
FIG. 7 is an elevational view of the transverse face of the leaning tower showing the left side of the tower at a higher elevation than the right side of the tower.

FIG. 7 is an elevational view of the transverse face of the leaning tower 12, showing side support beam segments 36, 36', which are positioned adjacent upright frame members 18. In this view, there are two horizontal support beams 32, 32' that are coupled to the upright frame members 18, 18' on the front and rear side of the tower 12. Extending between horizontal support beams 32, 32' is interconnecting member 42 that assists in maintaining the structural integrity of the tower 12 during the leveling process, along with third brace support structure 50.

Figure 8:
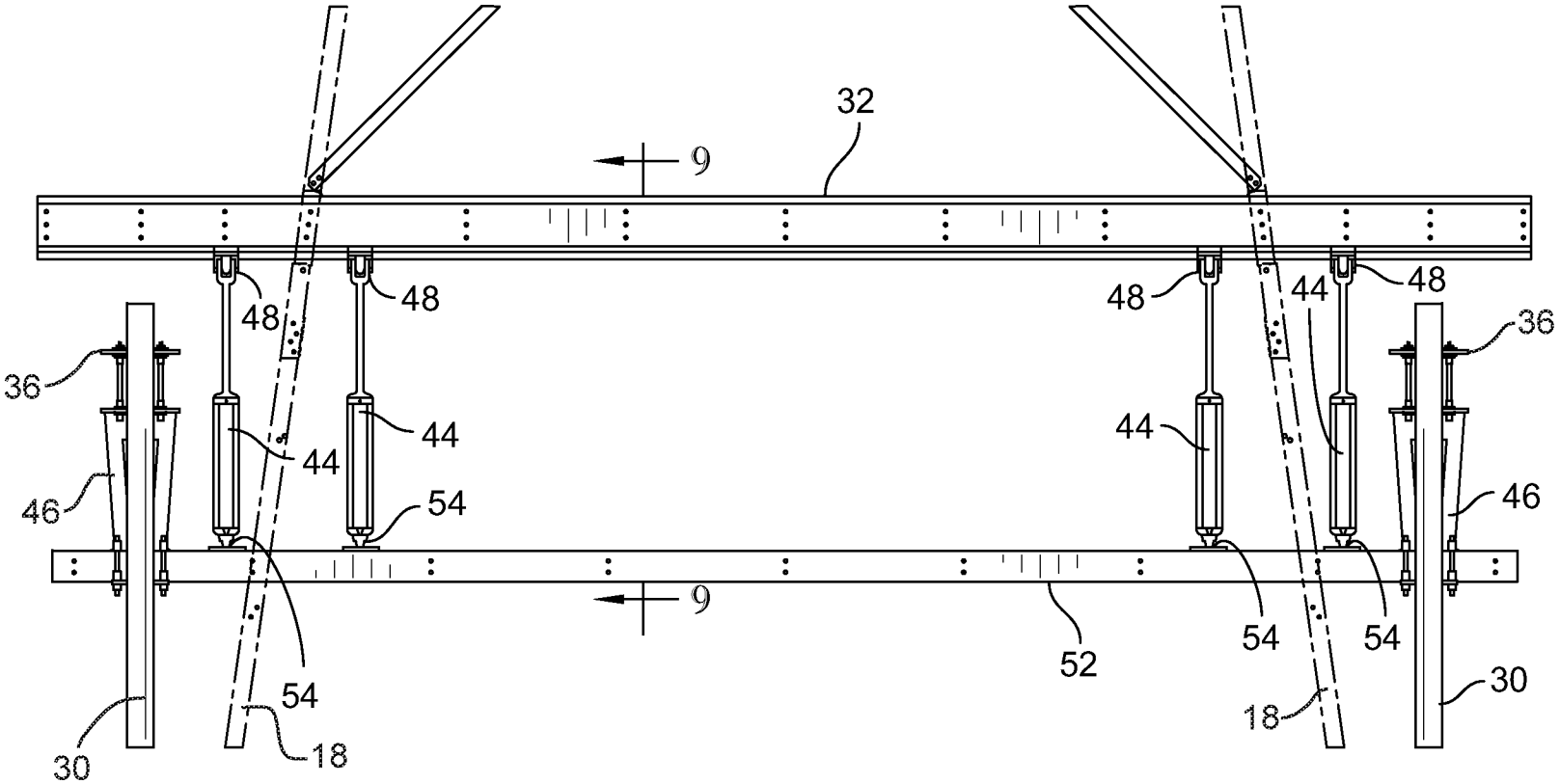
FIG. 8 is an elevational view of the longitudinal face of the tower showing temporary hydraulic cylinders secured to the horizontal support beam with the cylinders in their extended position before lowering the high side of the tower to level the tower.

Support beam segment 36 is coupled to vertical posts 30, as shown in FIG. 7. Support beam segment 36 is positioned on the high side of the tower 12 that is to be lowered in order to level the tower 12. The support beam segment 36 includes a support bracket 46 that is coupled to the beam segment 36 at a first end by use of threaded rods 47 and is secured at its lower end to hydraulic lift beam 52, as shown in FIGS. 7 and 8. Hydraulic lift beam 52 is positioned below horizontal support beam 32 and includes a series of telescopic hydraulic rams or cylinders 44 that are secured to the hydraulic lift beam 52 by a series of pivot brackets 54, as shown in FIG. 8.

Hydraulic rams 44 are secured to horizontal support beam by pivotal couplers 48, as shown in FIGS. 7 and 8. Beam segment 36' is coupled to support posts 30 to secure beam segment 36'. Hydraulic lift beam 52 is positioned sufficiently beneath horizontal support beam 32 so that hydraulic rams 44 can be secured in their fully extended position. This allows the high side of tower 12 to be lowered when hydraulic rams 44 are retracted. Pivot joints 54 and 48 at each side of hydraulic rams 44 allow for pivotal movement during the lowering of the high side of the tower 12 as tower pivots about pivot point 48'. In FIG. 8, four hydraulic rams 44 are used so that the high side of the tower 12 can be lowered uniformly.

Opposite side of longitudinal face of FIG. 4 is a second horizontal support beam 32' that is secured to the upright frame member 18', as shown in FIG. 7. Horizontal support beam 32' is secured to beam segment 36' by use of a clevis pin 48' to allow the tower 12 to pivot about an axis of rotation created by the clevis pin 48'.

Once the lifting structure 10 is in place, the weight of the tower 12 is fully supported by the lifting structure 10, as shown, for example, in FIG. 19. Once tower 12 is supported by lifting structure 10, lower portion of the upright frame members 18, 18', shown in dashed lines, are removed from the tower 12 so that the angle of the tower 12 can be adjusted. Once the lower portions of the upright frame members 18, 18' are removed, a hydraulic control system (not shown) causes each of the hydraulic rams 44 to be lowered to cause the high side of the tower 12 to be lowered about pivot axis 56 created by clevis pin 48'. This allows the high side of the tower 12 to be leveled.

Once the tower 12 is leveled, the lifting structure 10 maintains the position of the tower 12 so that new frame member segments 18, 18' can be installed onto the tower 12 and secured to new concrete footings, or other footings, in the ground. With the new frame member segments 18, 18' in place, the lifting structure 10 can be removed from the tower 12 and used to align the next tower. Alternatively the low side of the tower 12 can be raised with the lifting structure 10 by telescoping the hydraulic rams 44 outwardly that are attached to a low side of the tower 12. This would raise the low side of the tower 12 so that it can be leveled.

Figure 9:
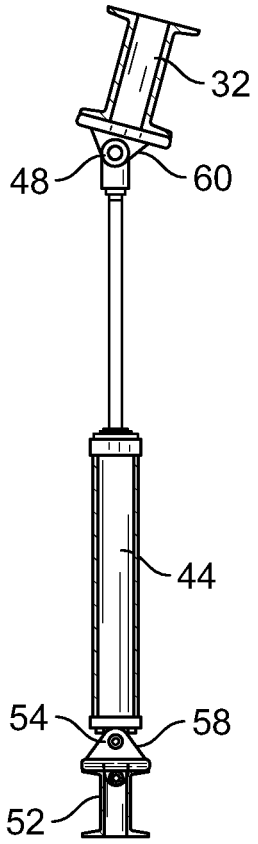
FIG. 9 is a sectional view taken along line 9-9 of FIG. 8 showing the attachment of the hydraulic cylinder to the horizontal support beam and the hydraulic lift beam.
Figure 10:
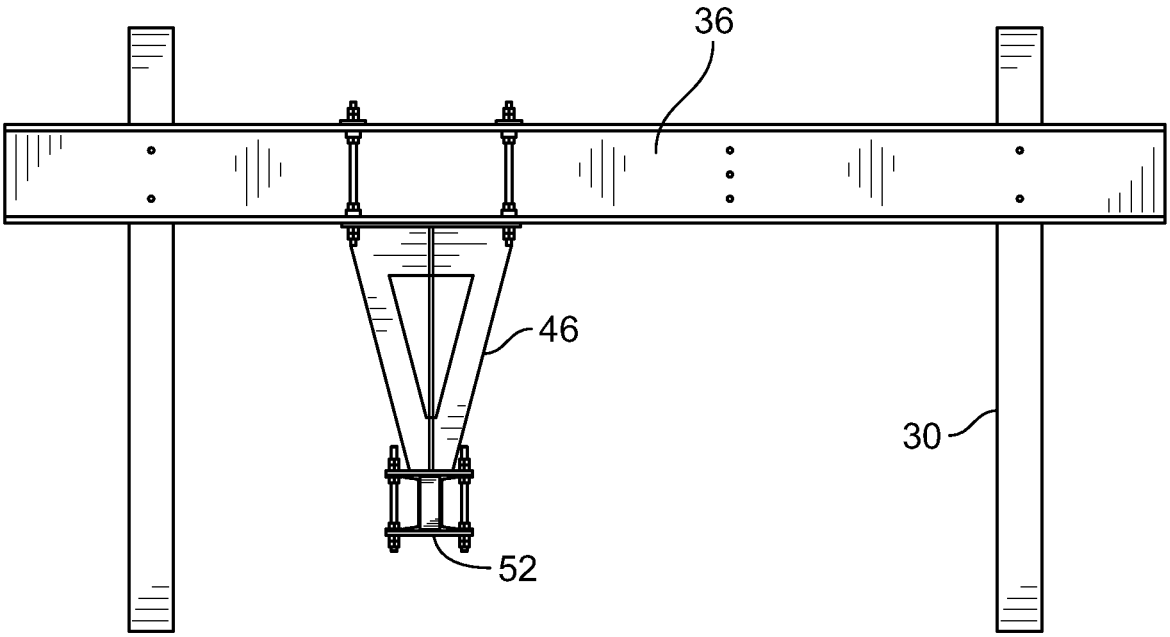
FIG. 10 is a sectional view taken along line 10-10 of FIG. 8 showing the attachment of the hydraulic lift beam to the beam segment by use of a triangular bracket.
Figure 11:
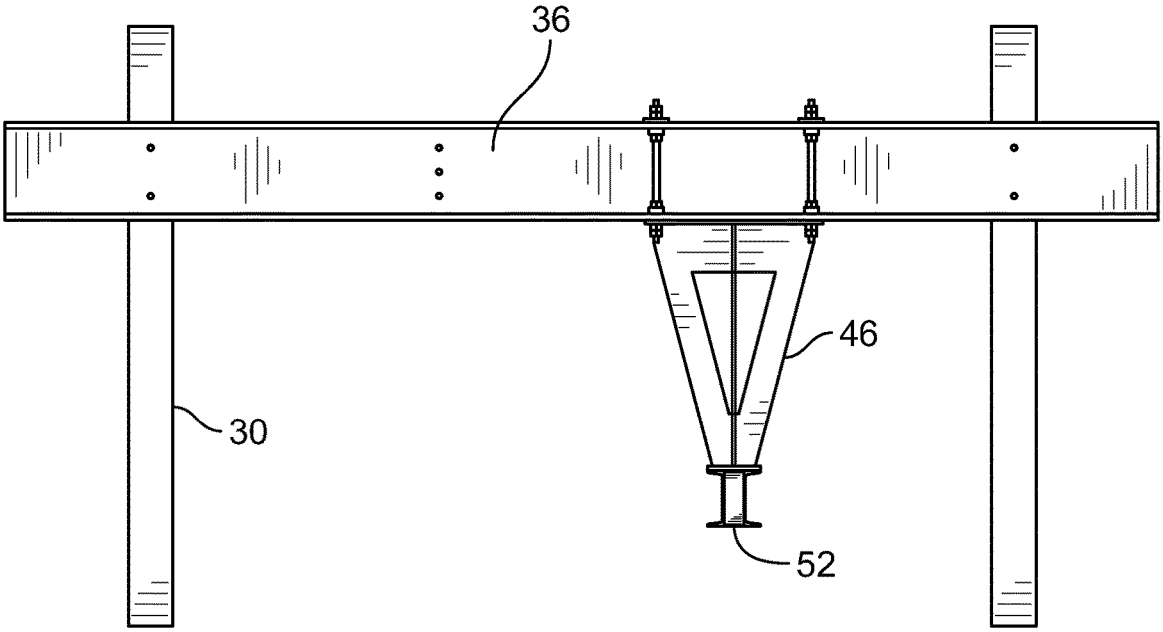
FIG. 11 is a sectional view taken along line 11-11 of FIG. 8 showing the attachment of the hydraulic lift beam to the beam segment by use of another triangular bracket.
Figure 12:
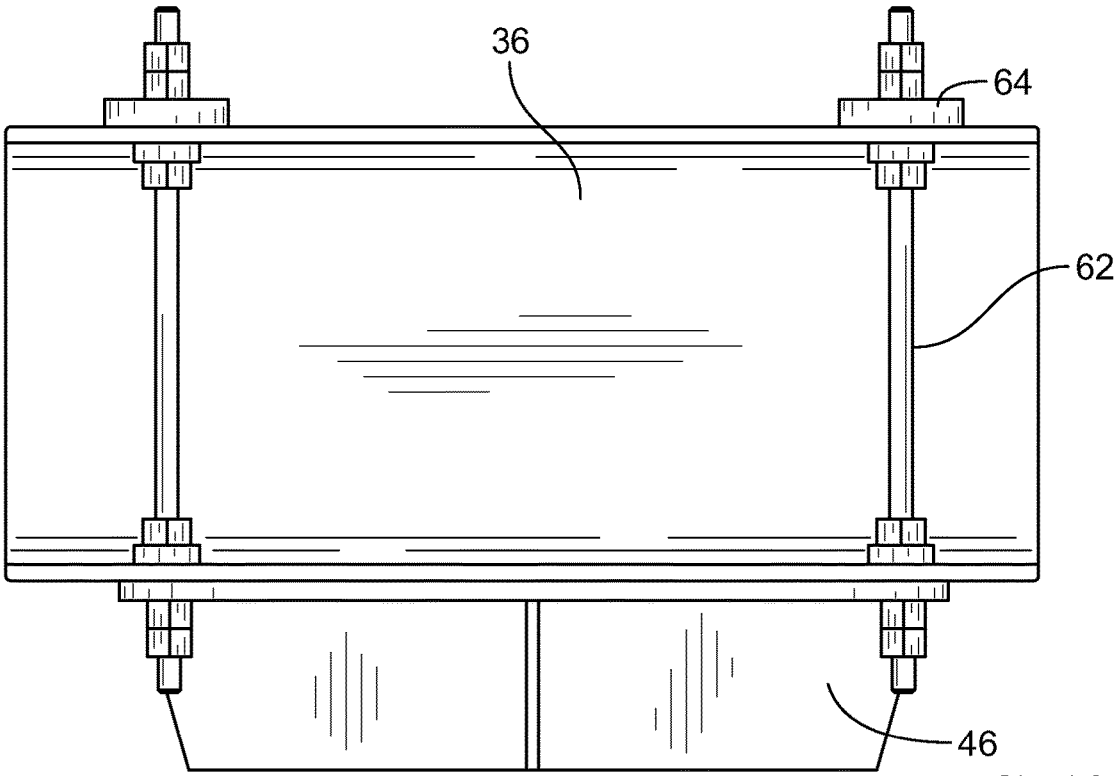
FIG. 12 is an enlarged view of FIG. 10 showing the connection of the bracket to the beam segment.
Figure 13:
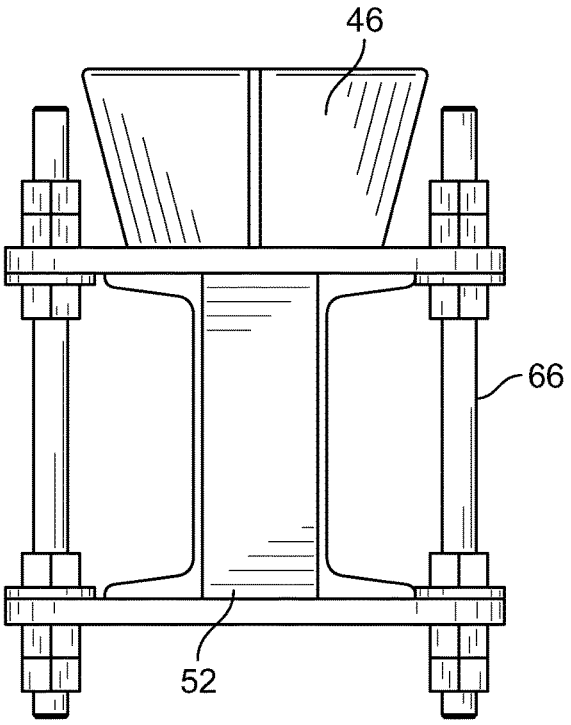
FIG. 13 is an enlarged view of FIG. 11 showing the connection of the hydraulic lift beam to the bracket.

FIG. 9 is a sectional view of FIG. 8 showing the hydraulic ram 44 coupled to hydraulic lift beam 52 at a first end 58 and to horizontal support beam 32 at a second end 60. Horizontal support beam 32 is positioned at an angle to match the angle or slope of the frame member segments 18, 18' of the tower 12. Hydraulic ram 44 includes pivot joints 54 and 48 at each side of hydraulic rams 44 allow for pivotal movement during the lowering of the high side of the tower 12. FIGS. 10 and 11 illustrate the coupling of support bracket 46 to beam segment 36. FIG. 12 illustrates the attachment of the support bracket to the beam segment 36 by use of threaded rods 62 and reinforcing plates 64. FIG. 13 illustrates the attachment of the hydraulic lift beam 52 to the support bracket 46 by use of threaded rods 66.

Figure 14:
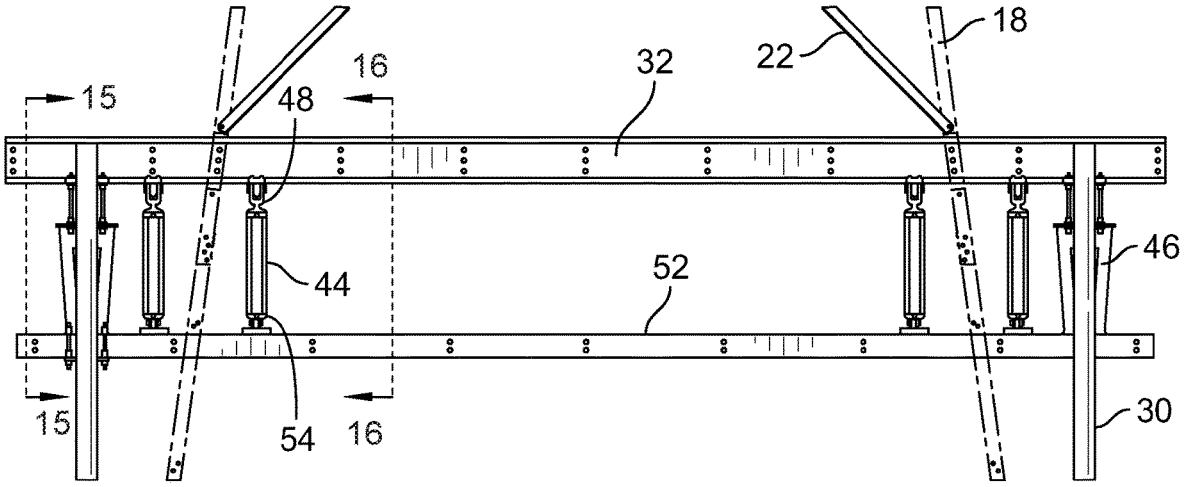
FIG. 14 is an elevational view of the longitudinal face of the tower, similar to FIG. 8, showing temporary hydraulic cylinders secured to the horizontal support beam with the cylinders in their retracted position after lowering the high side of the tower to level the tower.
Figure 15:
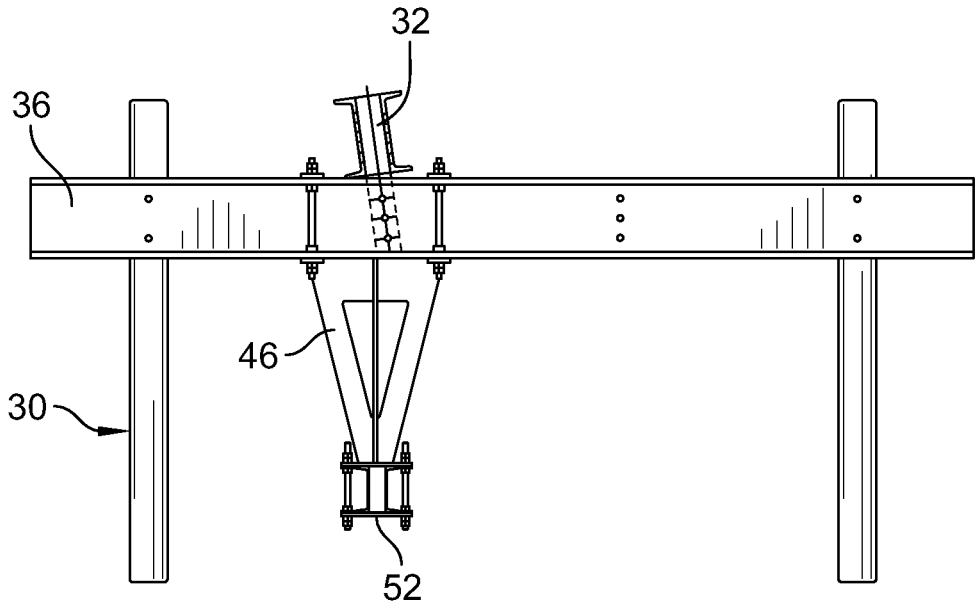
FIG. 15 is a sectional view taken along line 15-15 of FIG. 14 showing the attachment of the hydraulic lift beam to the beam segment by use of a triangular bracket.
Figure 16:
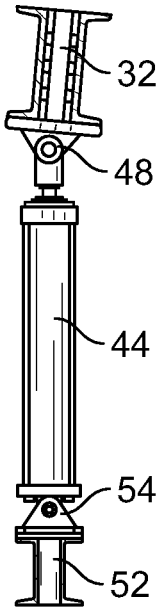
FIG. 16 is a sectional view taken along line 16-16 of FIG. 14 showing the attachment of the hydraulic cylinder to the horizontal support beam and the hydraulic lift beam.
Figure 17:
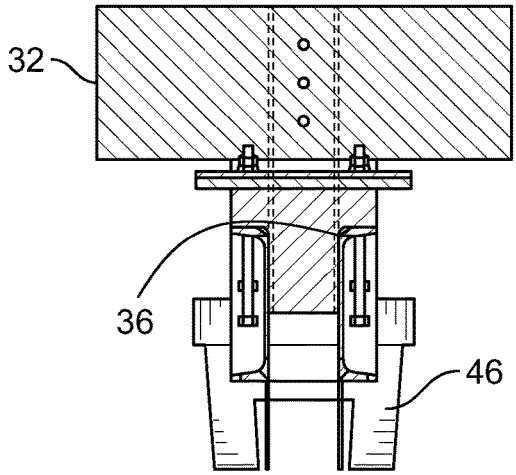
FIG. 17 is a sectional view taken along line 17-17 of FIG. 15 showing the position of the hydraulic lift beam with respect to the beam segment.
Figure 18:
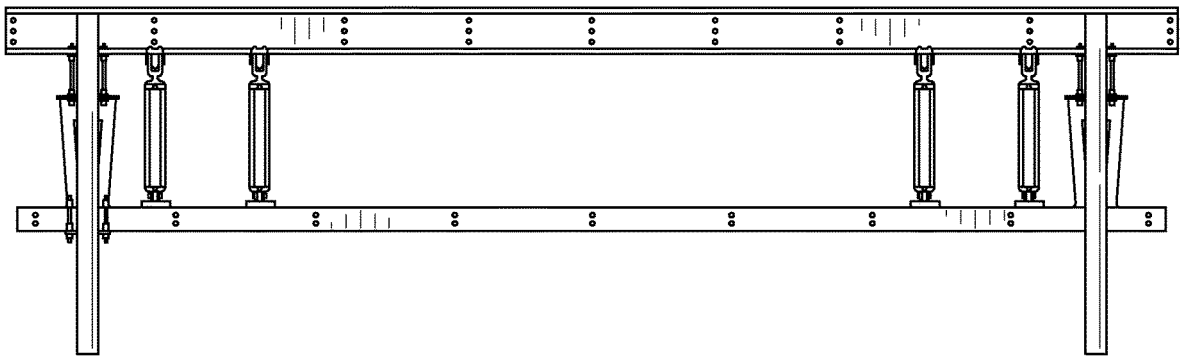
FIG. 18 is a series of elevational views showing the longitudinal hydraulic spacing along the hydraulic lift beam.

FIG. 14 is an elevational view of the longitudinal face of the tower 12 illustrating the hydraulic cylinders 44 in their retracted position, after the high side of the tower 12 has been leveled. At this stage, new frame segments 18, 18' can be installed to secure the tower 12 to the ground. FIG. 15 also shows the hydraulic cylinders 44 retracted so that the horizontal support beam 32 is positioned just above the beam segment 36. FIG. 16 illustrates the hydraulic cylinder 44 in its retracted position such that horizontal support beam 32 is at its lowest position. FIG. 17 is a sectional view taken about line T-T of FIG. 15, illustrating the orientation of the horizontal support beam 32 with respect to the beam segment 36.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An electrical or communication transmission tower leveling device for leveling an existing transmission tower with respect to a ground surface wherein the transmission tower includes a plurality of upright members and interconnecting lattice members, the leveling device comprising:

a frame structure positioned near the transmission tower;

a first support that is secured to a first side of a transmission tower that is leaning, the first support adapted to be pivotally secured to the frame structure to form an axis of rotation;

a second support that is secured to a second side of the transmission tower, opposite the first side of the transmission tower;

a lift support beam positioned on the same side of the transmission tower as the second support;

at least one lift cylinder that extends from the lift support to the second support;

a controller for controlling the extension and retraction of the at least one lift cylinder;

wherein extension or retraction of the at least one lift cylinder causes the transmission tower to rotate about the axis of rotation to allow for the transmission tower to be leveled.

2. The transmission tower leveling device of claim 1, wherein the lift support beam is secured to the frame structure.

3. The transmission tower leveling device of claim 2, wherein the at least one lift cylinder is pivotally coupled to the lift support beam.

4. The transmission tower leveling device of claim 3, wherein the at least one lift cylinder is pivotally coupled to the second support.

5. The transmission tower leveling device of claim 1, further including a series of brace members that are interconnected to form a lattice brace structure, the lattice brace structure coupled to the upright members of the transmission tower to stabilize the transmission tower during leveling.

6. The transmission tower leveling device of claim 1, further including an interconnecting member that extends between the first support and the second support.

7. The transmission tower leveling device of claim 6, wherein the first support and the second supports are in the form of elongated beams.

8. The transmission tower leveling device of claim 1, wherein the frame structure includes support posts and beam segments coupled to the support posts.

9. The transmission tower leveling device of claim 8, wherein the lift support is coupled to a beam segment with a support bracket.

10. A method for leveling an existing transmission tower with respect to a ground surface wherein the transmission tower includes a plurality of upright members and interconnecting lattice members, the method comprising the steps of: providing a frame structure positioned near the transmission tower; securing a first support to a first side of a transmission tower that is leaning, and pivotally securing the first support to the frame structure to form an axis of rotation; securing a second support to a second side of the transmission tower, opposite the first side of the transmission tower; positioning a lift support on the same side of the transmission tower as the second support; securing at least one lift cylinder to the lift support and to the second support; removing lower portions of the upright members of the transmission tower; controlling the extension and retraction of the at least one lift cylinder, wherein extension or retraction of the at least one lift cylinder causes the transmission tower to rotate about the axis of rotation to allow for the transmission tower to be leveled installing new upright member lower portions of the transmission tower.

11. The method of claim 10, further including the step of providing a series of brace members that are interconnected to form a lattice brace structure, the lattice brace structure being coupled to the upright members of the transmission tower to stabilize the transmission tower during leveling.

12. The method of claim 10, further including the step of providing an interconnecting member that extends between the first support and the second support.

13. The method of claim 12, wherein the first support and the second supports are in the form of elongated beams.

14. The method of claim 13, wherein the lift support is an elongated beam.

15. The method of claim 10, wherein the frame structure includes support posts and beam segments coupled to the support posts.

16. A lattice type transmission tower leveling device for leveling a transmission tower with respect to a ground surface wherein the transmission tower includes a plurality of upright members and interconnecting lattice members, the leveling device comprising: a frame structure positioned near the transmission tower; a first support beam that is adapted to be secured to a first side of a transmission tower that is leaning, the first support beam adapted to be pivotally secured to the frame structure to form an axis of rotation; a second support beam that is secured to a second side of the transmission tower, opposite the first side of the transmission tower; a lift support beam positioned on the same side of the transmission tower as the second support beam; a plurality of lift cylinders that are connected at one end to the lift support beam and to a second end to the second support beam; a controller for controlling the extension and retraction of the lift cylinders; wherein extension or retraction of the lift cylinders cause the transmission tower to rotate about the axis of rotation to allow for the transmission tower to be leveled.

17. The transmission tower leveling device of claim 16, further including a series of brace members that are interconnected to form a lattice brace structure, the lattice brace structure coupled to the upright members of the transmission tower to stabilize the transmission tower during leveling.

18. The transmission tower leveling device of claim 17, further including a pair of interconnecting member that extend between the first support beam and the second support beam.

* * * * *